US006735801B2

(12) United States Patent
Henley et al.

(10) Patent No.: US 6,735,801 B2
(45) Date of Patent: May 18, 2004

(54) MATTRESS

(75) Inventors: Alan W. Henley, Summerville, SC (US); Dana H. Delk, North Charleston, SC (US); Robert C. Novack, Cape Coral, FL (US); James J. Romano, James Island, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/440,905

(22) Filed: May 19, 2003

(65) Prior Publication Data

US 2003/0196271 A1 Oct. 23, 2003

Related U.S. Application Data

(60) Continuation of application No. 10/090,722, filed on Mar. 4, 2002, now Pat. No. 6,564,412, which is a division of application No. 09/177,772, filed on Oct. 23, 1998, now Pat. No. 6,351,862.

(60) Provisional application No. 60/063,118, filed on Oct. 24, 1997.

(51) Int. Cl.[7] ..... A47C 27/08

(52) U.S. Cl. ..... 5/713; 5/617; 5/710; 5/723

(58) Field of Search ..... 5/706, 710, 713, 5/722, 723, 732, 613, 615, 616, 617, 618

(56) References Cited

U.S. PATENT DOCUMENTS

| | | | |
|---|---|---|---|
| 433,905 | A | 8/1890 | Muller |
| 2,547,840 | A | 4/1951 | Smith |
| 2,623,574 | A | 12/1952 | Damsch |
| 4,481,686 | A | 11/1984 | Lacoste |
| 4,483,029 | A | 11/1984 | Paul |
| 4,518,203 | A | 5/1985 | White |
| 4,564,965 | A | 1/1986 | Goodwin |
| 4,637,083 | A | 1/1987 | Goodwin |
| 4,638,519 | A | 1/1987 | Hess |
| 4,644,597 | A | 2/1987 | Walker |
| 4,672,699 | A | 6/1987 | Goodwin |
| 4,685,163 | A | 8/1987 | Quillen et al. |
| 4,776,050 | A | 10/1988 | Goodwin |
| 4,803,744 | A | 2/1989 | Peck et al. |
| 4,879,777 | A | 11/1989 | Goodwin |
| 4,914,760 | A | 4/1990 | Hargest et al. |
| 4,942,635 | A | 7/1990 | Hargest et al. |
| 4,951,335 | A | 8/1990 | Eady |
| 4,953,247 | A | 9/1990 | Hasty |
| 4,967,431 | A | 11/1990 | Hargest et al. |
| 4,998,310 | A | 3/1991 | Olson |
| 5,008,965 | A | 4/1991 | Vrzalik |
| 5,016,304 | A | 5/1991 | Ryhiner |
| 5,020,176 | A | 6/1991 | Dotson |
| 5,029,352 | A | 7/1991 | Hargest et al. |
| 5,036,559 | A | 8/1991 | Hargest |
| 5,105,487 | A | 4/1992 | Hakamiun et al. |
| 5,168,591 | A | 12/1992 | Hakamiun et al. |
| 5,249,318 | A | 10/1993 | Loadsman |
| 5,267,364 | A | 12/1993 | Volk |
| 5,325,551 | A | 7/1994 | Tappel et al. |
| 5,402,542 | A | 4/1995 | Viard |

(List continued on next page.)

FOREIGN PATENT DOCUMENTS

| | | |
|---|---|---|
| WO | WO 95/31920 | 11/1995 |
| WO | WO 96/33641 | 10/1996 |

*Primary Examiner*—Lynne H. Brown
*Assistant Examiner*—James M. Hewitt
(74) *Attorney, Agent, or Firm*—Bose McKinney & Evans LLP

(57) ABSTRACT

A mattress having a head end and a foot end comprises a first support section configured to support an occupant's feet, legs, and seat, and a second support section located adjacent the head end of the mattress to support an occupant's back and head. A portion of the head support section is movable toward the head end of the mattress as the second support section is moved to an elevated position relative to the first support section.

22 Claims, 8 Drawing Sheets

U.S. PATENT DOCUMENTS 5,493,742 A 2/1996 Klearman
5,537,701 A 7/1996 Elliott
5,539,943 A 7/1996 Romano
5,560,056 A 10/1996 Tai
5,586,348 A 12/1996 Toivio et al.
5,623,736 A 4/1997 Soltani et al.
5,655,239 A 8/1997 Caparon et al.
5,680,662 A 10/1997 Purdy et al.
5,682,631 A 11/1997 Weismiller et al.
5,699,569 A 12/1997 Schwarz-Zohrer
5,740,573 A 4/1998 Boyd
5,755,000 A 5/1998 Thompson
5,815,865 A 10/1998 Washburn et al.
5,873,137 A 2/1999 Yavets-Chen
5,966,762 A 10/1999 Wu
5,966,763 A 10/1999 Thomas et al.
5,991,949 A 11/1999 Miller, Sr. et al.
6,006,379 A 12/1999 Hensley
6,006,383 A 12/1999 Pile et al.

MATTRESS

CROSS-REFERENCE TO RELATED APPLICATIONS

This application is a continuation of U.S. application Ser. No. 10/090,722, filed Mar. 4, 2002, now U.S. Pat. No. 6,564,412, which is a divisional of U.S. application Ser. No. 09/177,772, filed Oct. 23, 1998, now U.S. Pat. No. 6,351,862, which claims the benefit of U.S. provisional application Serial No. 60/063,118, filed Oct. 24, 1997, all of which are expressly incorporated by reference herein.

BACKGROUND AND SUMMARY OF THE INVENTION

The present invention relates to a mattress which is portable between bed frames. More particularly, the present invention relates to a mattress having a plurality of modular mattress zones including air bladders and air fluidized sections. The mattress replacement of the present invention has reduced maintenance requirements compared to other air fluidized beds.

The present invention provides a modular mattress replacement having both air fluidized sections and regular air bladder sections to support a patient. The air fluidized sections provide reduced pressure against the patient's body resting on the mattress. In illustrated embodiments, the air fluidized sections are located in the seat section and foot or heel section of the mattress. It is understood that the air fluidized sections may be positioned at any desired location within the mattress.

The air fluidized sections are supplied with air from a blower to move a fluidizable medium within the air fluidized sections. The mattress also includes air cushions or bladders located adjacent the fluidized sections. In the illustrated embodiment, the air cushions are used in a head section of the mattress and in a knee section of the mattress. The head air cushions of the present invention are configured to move toward a head end of the bed as the head section of the mattress is articulated to an elevated position to reduce shear forces on a person lying on the mattress.

Air fluidized beds have been used as patient support systems. In this type of bed, a fluidizable medium such as tiny spheres formed of glass, ceramics, or silicone are contained within a suitable support and fluidized by air passing through the support mechanism to support the patient. In a common design, the fluidizable medium is supported by a diffuser board which is permeable to air but impermeable to the fluidized medium. A retaining mechanism which is impermeable to air is positioned around outer edges of the diffuser board. A flexible cover encloses the fluidizable medium and is permeable only to air flow.

Conventional air fluidized beds are typically tied to the structure of a frame. The air fluidized beds are typically heavy and rather difficult to move. The present invention provides a replacement mattress which includes air fluidized sections. The replacement mattress, including the air fluidized sections, is not tied to a particular frame. In other words, the mattress replacement can be easily moved from one frame to another to provide the benefits of an air fluidized mattress on any frame.

According to one aspect of the present invention, a mattress includes an outer cover having an interior region and a top support surface, and a module receiving section located in the interior region of the cover. The module receiving section has a first coupling portion in fluid communication with an air supply. The mattress also includes an air fluidized module having a first chamber containing a fluidizable material, a second chamber, a second coupling portion coupled to the module in fluid communication with the second chamber, and an air permeable sheet located between the first and second chambers. The air fluidized module is configured to be located in the module receiving section, and the first and second coupling portions are configured to be coupled together to provide fluid communication between the air supply and the second chamber so that air from the air supply passes into the second chamber and through the air permeable sheet to fluidize the fluidizable material in the first chamber.

In the illustrated embodiment, the air fluidized module has a top surface which is air permeable. The illustrated mattress further includes a non-fluidized module including a flexible air impermeable outer wall defining an interior region and a third coupling portion coupled to the outer wall in fluid communication with the interior region of the non-fluidized module. The fluidized module and the non-fluidized module are interchangeable in the module receiving section with the first coupling portion being configured to couple alternatively with one of the second coupling portion of the fluidized module and the third coupling portion of the non-fluidized module.

Also in the illustrated embodiment, a manifold is located between the air supply and the first coupling portion of the module receiving section. A control valve is configured to control the rate of air supply to the first coupling portion.

According to another aspect of the present invention, a support module is provided for a mattress. The support module includes a base formed from an air impermeable material. The base includes a bottom surface and a side wall configured to define an interior region. The support module also includes an air permeable diffuser located within the interior region of the base. The diffuser is coupled to the side wall of the base to define an upper air fluidized chamber configured to receive a fluidizable material therein and a bottom plenum. The support module further includes an air impermeable top surface coupled to the base, and a plurality of baffles coupled to the base. The baffles are located in the plenum. The support module also includes an air connector coupled to the base in communication with the plenum to supply air to the plenum to fluidize the fluidizable material within the air fluidized chamber above the plenum.

In one illustrated embodiment, the air fluidized chamber includes an access port providing for removing and inserting the fluidizable material. In another illustrated embodiment, a top cover including the air permeable top surface and a side wall extending from the top surface, the side wall of the top cover is coupled to the side wall of the base. The top cover is removable from the base to provide access to the fluidizable material.

In the illustrated embodiment, at least one grounding strip is coupled to the side wall of the base. A conductive cable is coupled to the at least one grounding strip to provide a ground connection for the support module.

In one illustrated embodiment, base includes a bottom surface, a frame, and a separate side wall coupled together to form the base. The frame is coupled to the side wall of the base and is configured to support the diffuser. In the illustrated embodiment, the frame includes a plurality of webs extending between opposite sides of the frame. The baffles are coupled between the webs and the bottom surface of the base. The baffles are each formed to include a plurality of apertures to permit air flow through the plenum. A plurality of fasteners is coupled to the side wall of the base with the fasteners being configured to secure the support module within the mattress.

According to yet another aspect of the present invention, a mattress having a head end and a foot end includes a first support section configured to support an occupant's feet, legs, and seat, and a head support section located adjacent the head end of the mattress. The head support section has a base portion and a shear reducing support surface pivotably coupled to the base portion. The mattress also includes a coupler connected between the first support section and the head support section so that the head support section moves toward the head end of the mattress as the head support section is moved to an elevated position relative to the first support section.

In the illustrated embodiment, the first mattress section includes an air fluidized module containing a fluidizable material. The fluidized module is connected to an air supply. The first support section also includes an inflatable non-fluidized zone connected to the air supply.

Also in the illustrated embodiment, the head support includes a set of air cushions pivotably coupled to the base. A second set of air cushions is illustratively located above the air cushions pivotably coupled to the base.

According to a further aspect of the present invention, a mattress includes an outer cover formed from an air impermeable material. The outer cover is configured to define an interior region and having a top support surface. The mattress also includes at least one air fluidized support module located within the interior region of the cover of the mattress. The air fluidized module includes a plenum, a chamber located over the plenum, and a fluidizable material located within the chamber. The chamber includes an air permeable top surface. The mattress further includes a connector coupled to the plenum, the connecter being configured to be coupled to an air supply to supply air to the plenum and fluidize the fluidizable material located within the chamber. The mattress also includes a vent connector coupled to the outer cover in communication with the interior region of the cover. The vent connector is configured to exhaust air from the interior region of the cover.

In the illustrated embodiment, a fan is coupled to the vent connector to assist removal of air from the interior region of the cover. A second connector is coupled to the outer cover. The second connector is configured to be coupled to an air supply. A tube is coupled between the second connector on the outer cover and the connector of the plenum to supply air to the plenum through the outer cover.

In the illustrated embodiment, a heat exchanger is coupled between the air supply and the second connector of the outer cover. An air bladder is located adjacent the air fluidized support module. An air supply line extends through the air bladder and is coupled to the connector to supply air to the plenum. The air bladder is also formed to include a vent slot in communication with the vent connector. A tube having a plurality of holes is coupled to the air bladder in communication with the vent slot. The tube is coupled to the vent connector.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

A detailed description particularly refers to the accompanying figures in which.

DETAILED DESCRIPTION OF THE DRAWINGS

Figure 1:
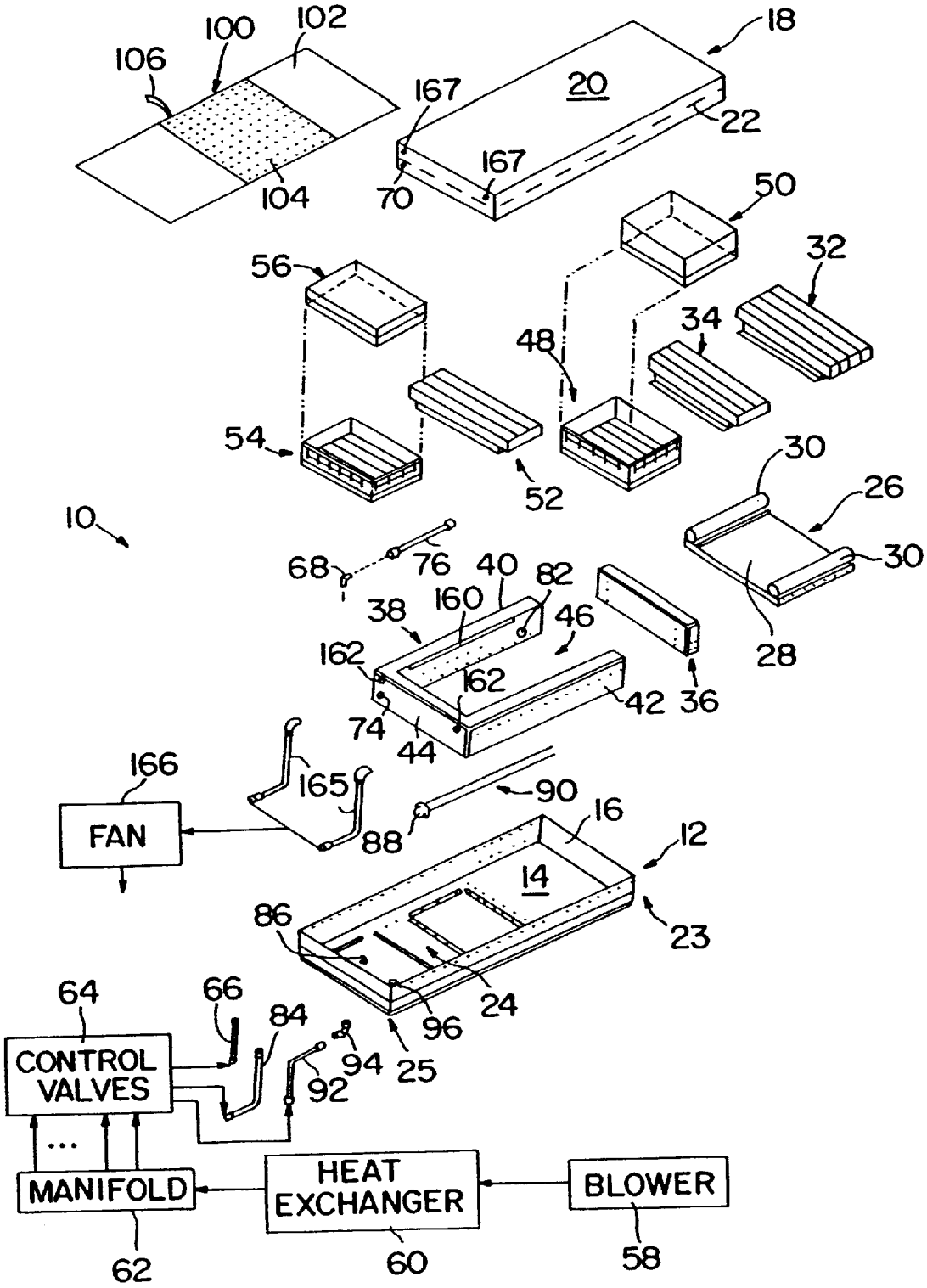
FIG. 1 is an exploded perspective view of the mattress replacement of the present invention with a plurality of modular zones, including air fluidized zones and air cushions, located within an outer cover, and illustrating controls for the replacement mattress illustrated in diagrammatical form.

Referring now to the drawings, FIG. 1 illustrates a mattress replacement apparatus 10 designed for use in any bed frame or other support surface. The mattress 10 includes a bottom cover or base 12 having a bottom surface 14 and a sidewall 16. Base 12 is illustratively made from an air impervious, wipeable and cleanable plastic material. Base includes a head end 23 and a foot end 25.

Mattress 10 also includes a top air impermeable cover 18 having a top surface 20 and a downwardly extending sidewall 22. Top cover 18 is secured to base 12 with suitable fasteners such a zipper, snaps, or other coupling mechanism. An interior region 24 of mattress 10 is defined between the base 12 and the cover 18. A plurality of modular mattress components are located within the interior region 24 of mattress 10.

An air support bladder 26 is located within interior region 24 of cover 12 adjacent head end 23. Air support bladder 26 includes a center inflatable portion 28 and a pair of spaced apart inflatable tubes 30. A head zone air cushion 32 and a shoulder zone air cushion 34 are located above surface 28 of air support 26. A lumbar cushion 36 is located within interior region 24 of base 12 adjacent shoulder zone cushion 34. A U-shaped air wall bladder 38 having side sections 40 and 42 and foot end section 44 is also located within interior region 24 of mattress 10 adjacent lumbar cushion 36.

An air fluidized seat section or zone 48 is located within a center space 46 defined by air wall bladder 38. A seat section cover 50 is coupled over the air fluidized seat zone 48. A knee zone air cushion 52 is located within center space 46 adjacent air fluidized seat zone 48. An air fluidized foot zone 54 is located within center space 46 of air wall bladder 38 between knee zone cushion 52 and end wall 44. A foot zone cover 56 is coupled over the air fluidized foot zone 54. In the illustrated embodiment, cushions 32, 34, and 52 provide non-fluidized modules, and seat zone 48 and foot zone 54 provide air fluidized modules of the mattress 10.

An air blower 58 is configured to blow air through a heat exchanger 60 and into a manifold 62. Manifold 62 is coupled to a plurality of control valves 64 which control air pressure supplied to various air zones within the mattress 10 in a conventional manner.

Figure 8:
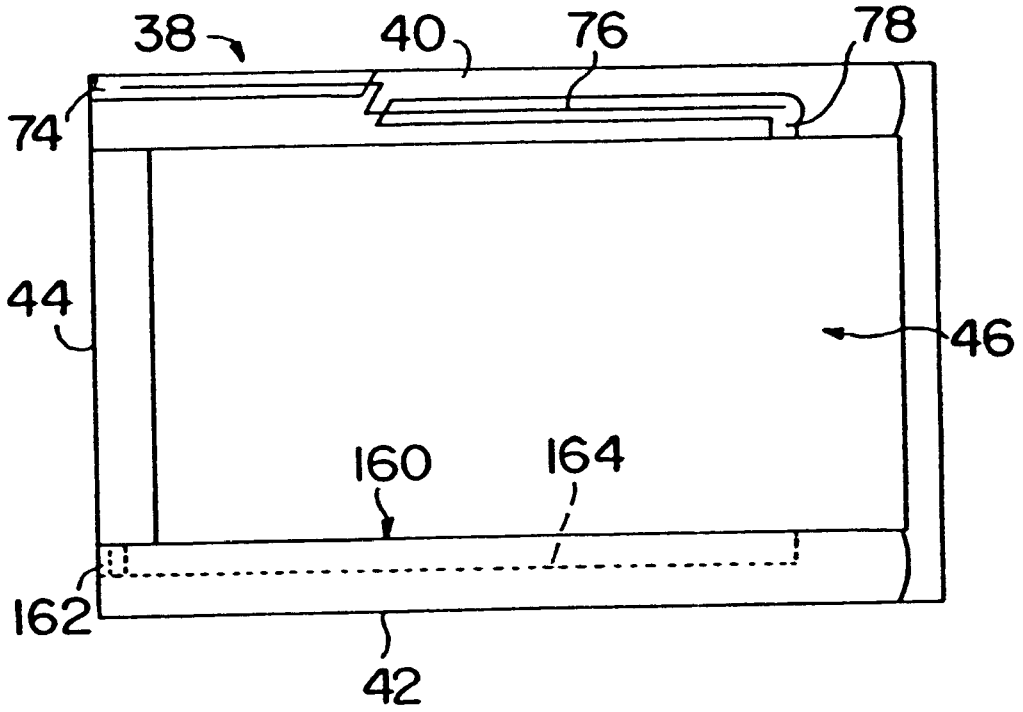

Air from one of the control valves passes through tube 66 to connecter 68 which passes through an aperture 70 formed in top cover 18 into an aperture 74 formed in air wall bladder 38. Tube 76 is coupled to connector 68. Tube 76 extends through side portion 40 of air wall bladder 38. Tube 76 is coupled to an L-shaped connector 78 as shown in FIG. 8 to supply air to an inlet 80 of air fluidized seat zone 48 illustrated in FIGS. 2 and 3. Connector 78 passes through aperture 82 formed in side section 40 of air wall bladder 38.

Another supply tube 84 extends through an aperture 86 formed in bottom surface 14 of cover 12 and is coupled to a manifold connector 88. Manifold connector 88 includes a plurality of output lines 90 to supply the various air zone bladders 26, 32, 34, 36, 38, and 52 with air through suitable connectors. Each zone includes snaps or other suitable fasteners to secure the zone to the cover 12 and adjacent zones.

Figure 4:
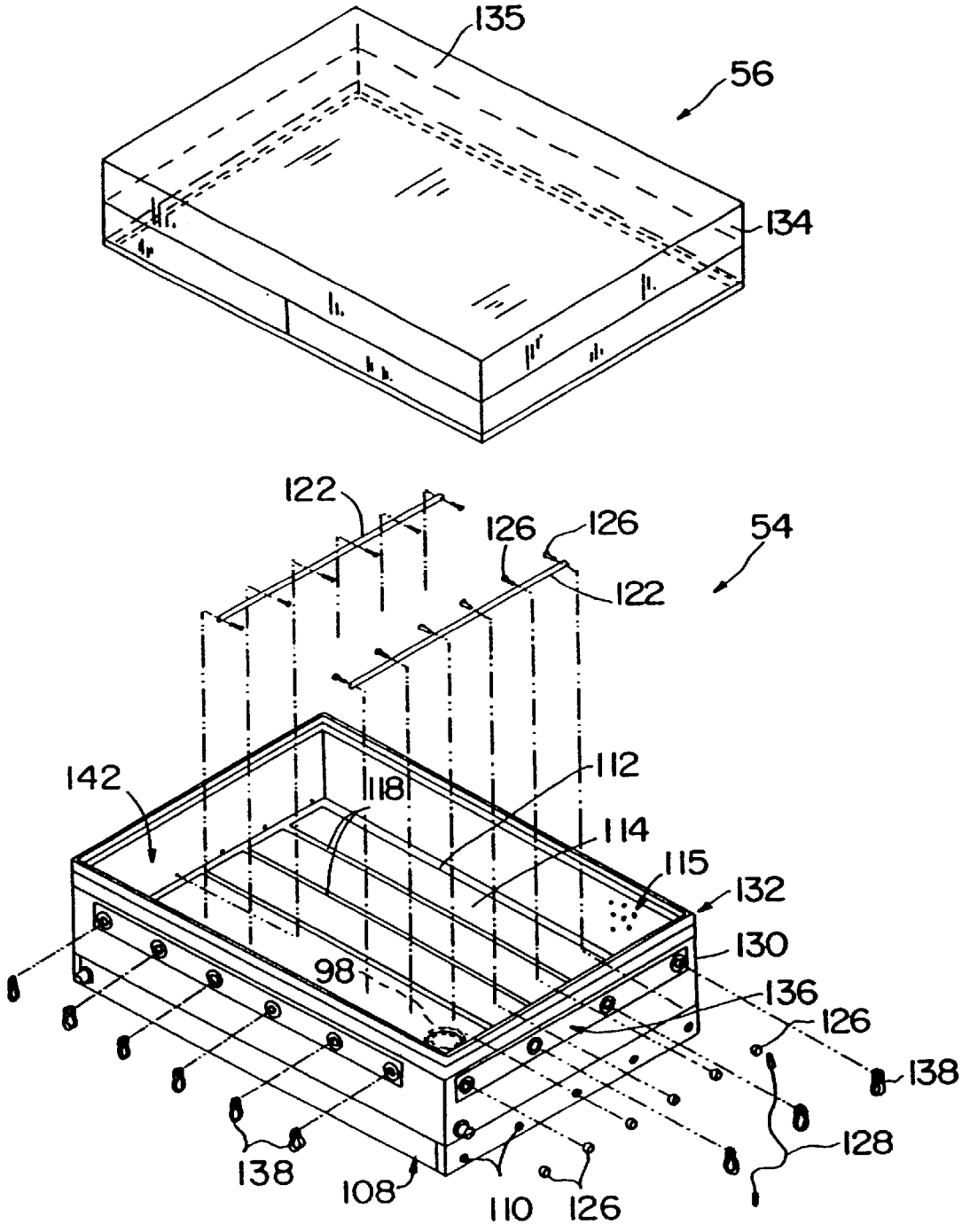
FIG. 4 is an exploded perspective view of an air fluidized foot zone of the mattress replacement.
Figure 5:
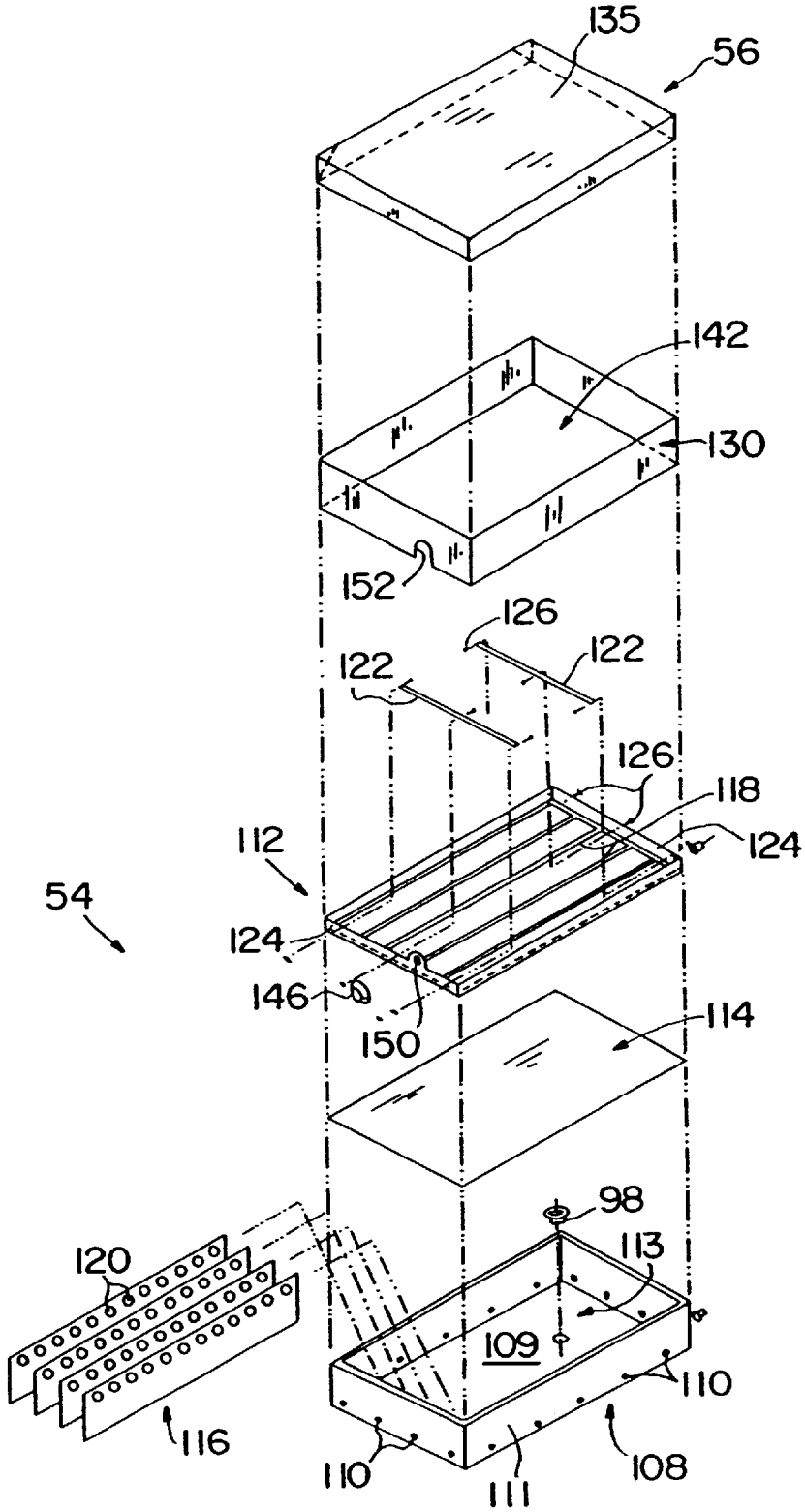
FIG. 5 is an exploded perspective view of another embodiment of the air fluidized foot zone.

Another air inlet tube 92 is coupled to L-shaped connector 94 which extends through an aperture 96 formed in the bottom surface 14 of cover 12. The connector 94 is coupled to an air inlet 98 of air fluidized foot zone 54 as illustrated in FIGS. 4 and 5.

FIG. 1 illustrates an air quilt or blanket 100 designed to fit on top surface 20 of impermeable cover 18. Illustratively, the air blanket 100 is made of a disposable or washable material. The blanket 100 includes an impermeable layer 102 and an air permeable layer 104 which is supplied with air through a suitable connector 106. Layer 104 of air blanket 100 soaks up any drainage from a patient lying on the mattress 10 and also supplies air flow through layer 104. It is understood that the air flow layer 104 may extend across the entire air blanket 100, if desired.

The air blanket 100 permits continuous air flow past the patient while maintaining the impermeable cover 18 to seal interior region 24 of mattress 10. Therefore, the mattress components and the air fluidizable medium within the air fluidized seat zone 48 and air fluidized foot zone 54 are not contaminated by fluids from the patient or other contaminants entering the mattress 10.

Figure 2:
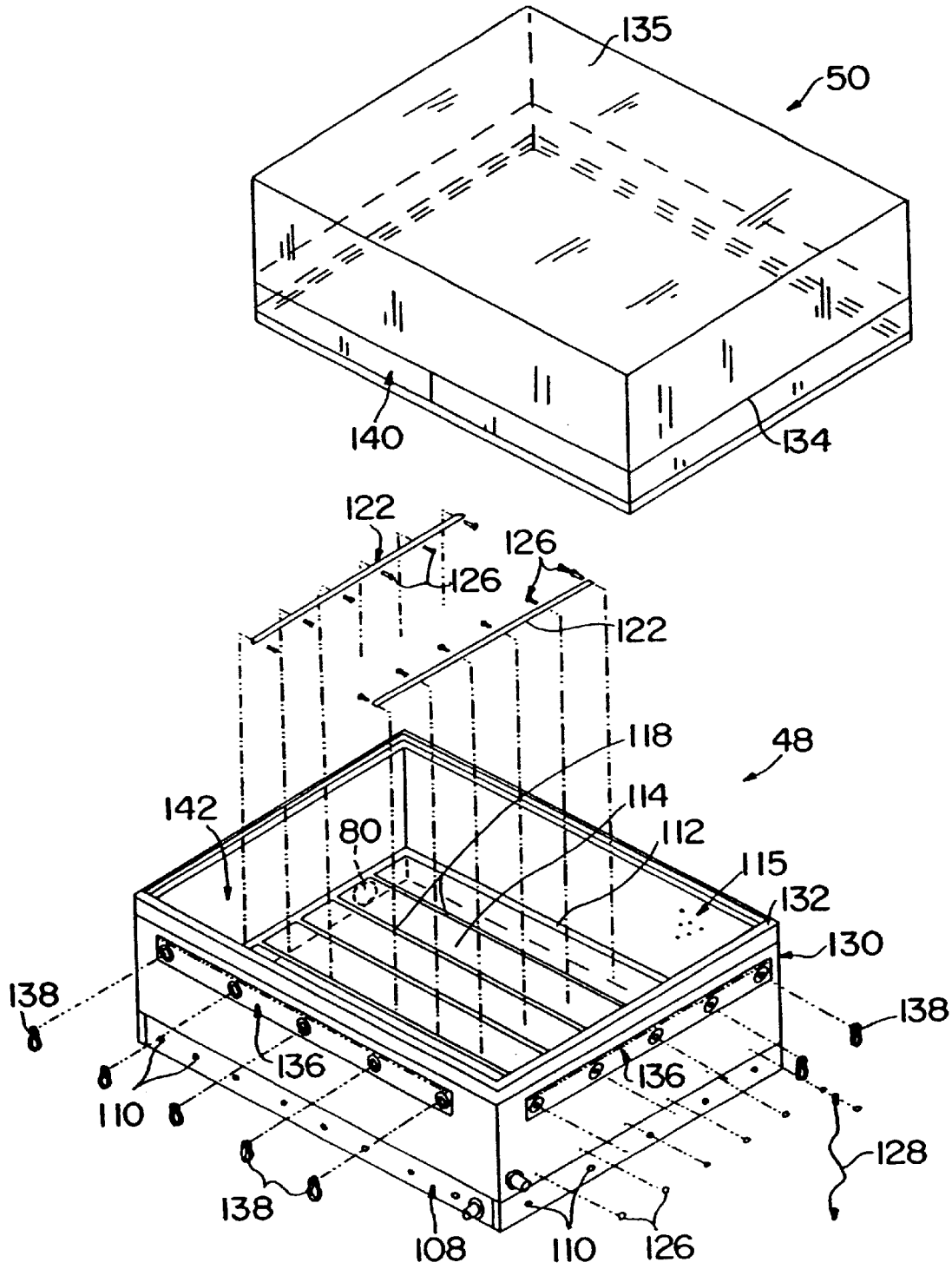
FIG. 2 is an exploded perspective view of an air fluidized seat zone of the present inventions.
Figure 3:
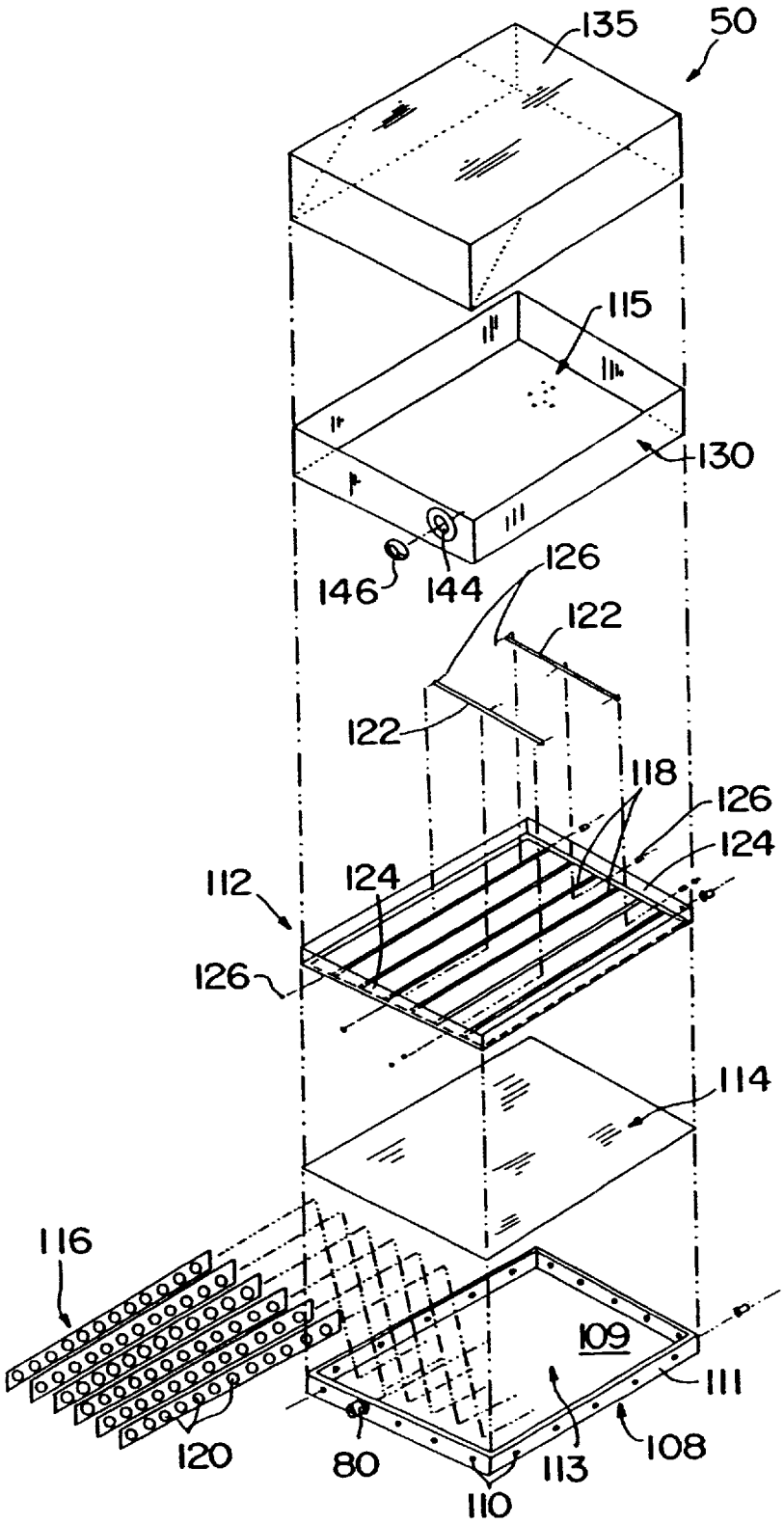
FIG. 3 is an exploded perspective view of another embodiment of the air fluidized seat zone.

Additional details of the air fluidized seat zone 48 and cover 50 are illustrated in FIGS. 2 and 3. A base 108 has a generally rectangular shape. A plurality of snaps 110 or other fasteners are provided to secure the air fluidized seat zone 48 to adjacent bladders. A frame 112 is configured to secure a diffuser sheet 114 to the base 108 as best shown in FIG. 3. The base 108 and frame 112 are preferably made from a urethane coated nylon twill and are impervious to air. Base 108 includes a bottom surface 109 and sidewall 111. Frame 112 is secured around its outer perimeter to an outer perimeter of base 108 by ultrasonic or RF welding and by sewing to provide both strength and sealing. A plurality of baffles 116 are coupled between the diffuser sheet 114 and bottom surface 109 of base 108. Baffles 116 are illustratively welded and sewn to bottom surface 109 and to webs 118 of frame 112 and to diffuser sheet 114. Baffles 116 maintain the plenum height and shape during operation. The baffles 116 include a plurality of apertures 120 to permit air flow through inlet 80 to pass through diffuser sheet 114 from the entire plenum 113 which is formed between base 108 and sheet 114.

The diffuser sheet 114 is illustratively formed from a suitable woven fabric such as a twill weave which permits controlled air flow through the sheet 114. Sheet 114 provides sufficient air flow and pressure drop for movement of the fluidizable medium 115 as discussed below. Illustratively, diffuser sheet 114 is a model number S-1500-SK11 woven material available from Tetko. Diffuser sheet 114 may also be formed from a microporous film made from, for example, polyurethane or other suitable material, which provides sufficient air flow and pressure drop for movement of the fluidizable medium 115.

Metal strips 122 are coupled to opposite sidewalls 124 of frame 112 by suitable fasteners 126. The metal strips provide a ground connection for the air fluidized seat zone 48. As illustrated in FIG. 2, one of the fasteners 126 on each side is coupled to a first end of a conductive cable 128 to provide a ground connection. An opposite end of each cable 128 is coupled to a controller outside the mattress 10.

A sidewall 130 formed from an air impervious material is welded and sewn to the perimeter of frame 112. In the embodiment illustrated in FIG. 2, the sidewall 130 includes a top zipper 132 configured to the coupled to a zipper 134 on cover 50. Sidewall 130 in FIG. 2 also includes anchor portions 136 and fastening clips 138 to hold down a flap 140 of top cover 50. At least a top surface 135 of cover 50 is formed from an air permeable material.

The fluidizable medium 115 is loaded into the interior region by unzipping the cover 50 in the embodiment shown in FIG. 2. In another embodiment illustrated in FIG. 3, the sidewall 130 is formed to include an aperture 144 configured to receive a cap 146. In the FIG. 3 embodiment, the cover 50 is sewn and welded to the sidewall 130. The fluidizable medium is loaded and drained through the inlet aperture 144.

Illustratively, the fluidizable medium 115 of the present invention includes both light weight beads and heavy weight beads to provide an overall reduced average weight for the beads. Reduced weight is important since the fluidized zones 48 and 54 are used in replacement mattress. Two types fluidizable medium 115 are illustratively mixed together and located within the interior region 142 of the fluidized seat section 48. The first size fluidizable medium 115 is illustratively conventional size tiny spheres or beads formed from glass, ceramics, or silicon having an average size between about 50 and about 150 microns, with a specific gravity of about 2.5. These conventional size beads are mixed with beads made of Styrofoam or other suitable material having a size of about $^{15}/_{1000}$ to about $^{20}/_{1000}$ of an inch, with a specific gravity of about 1. Hollow beads may also be used to reduce weight. Mixture ratios for the different sizes of fluidizable medium can be adjusted depending upon the particular application. By mixing of the beads in this manner, the average weight of the fluidizable medium 115 is less than the average weight of the conventional size beads.

The lighter average weight of the fluidizable medium 115 of the present invention facilitates transfer of the mattress from one bed frame to another. The mattress 10 can be used on conventional bed frames. The modular components within the mattress 10 are replaceable sections. In other words, the air fluidized zones 48 and 54 may be replaced with standard air cushions if desired. If air fluidized sections such as 48 and 54 are required due to a particular therapy situation, then these modules or sections can be added to the mattress 10 as needed.

FIGS. 4 and 5 illustrate details of the air fluidized foot zone 54 of the present invention. FIGS. 4 and 5 include structural components which function in the same or similar manner as components in the air fluidized seat zone 48 of FIGS. 2 and 3. Those elements in FIGS. 4 and 5 identified by reference numbers the same as in FIGS. 2 and 3 perform the same or similar function. The dimensions of the rectangular fluidized zone 54 are different from the dimensions of seat zone 48 in FIGS. 2 and 3. In addition, air is supplied into a lower plenum defined between base 108 and diffuser sheet 112 through an inlet 98 formed in bottom surface 109 of base 108. In the embodiment of FIG. 4, the cover 56 is coupled to the sidewall 130 by a zipper 132, 134. In the FIG. 5 embodiment, top cover 56 is sewn and welded to sidewall 130. The fill inlet aperture 150 is formed in frame 112. A cap or closure 146 is provided to permit draining and filling of the fluidizable medium 115 into an interior region 142 of the foot zone 54. A notched portion 152 is formed inside wall 130 to accommodate the aperture 150.

In operation, air is supplied to the lower plenum defined between base 108 and diffuser sheet 114 through either inlet 80 in FIGS. 2 and 3 or inlet 98 in FIGS. 4 and 5. The baffles 116 maintained at plenum height and rectangular shape. Air diffuses through diffuser sheet 114 with sufficient air flow velocity and pressure drop to fluidize the fluidizable medium 115 located within interior region 142. Air can pass out through fluidized seat zone 48 and fluidized foot zone 54 through top covers 50 and 56, respectively. The top covers 50 and 56 are formed from a air permeable filter material (at least on top surface 135) which permits air flow through the cover 50 or 56 but does not permit the fluidizable medium 115 to escape through the covers 50 and 56. The fluidized seat zone 48 and foot zone 54 provide excellent support for a patient on the mattress 10 and reduce the likelihood of formation of bed sores because of equal distribution of pressure. Fluidized sections 48 and 54 are also well suited for treatment of patients with skin grafts because they do not produce high shear forces, which are frictional forces generated when the patient moves on the bed. The modular mattress operates at a cooler temperature than conventional fluidized beds.

Figure 6:
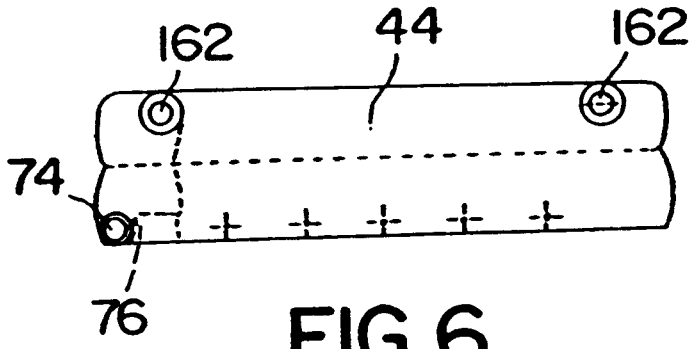
FIGS. 6–8 illustrate details of an air wall bladder configured to be located within the mattress surrounding the air fluidized foot zone and seat zone.
Figure 7:
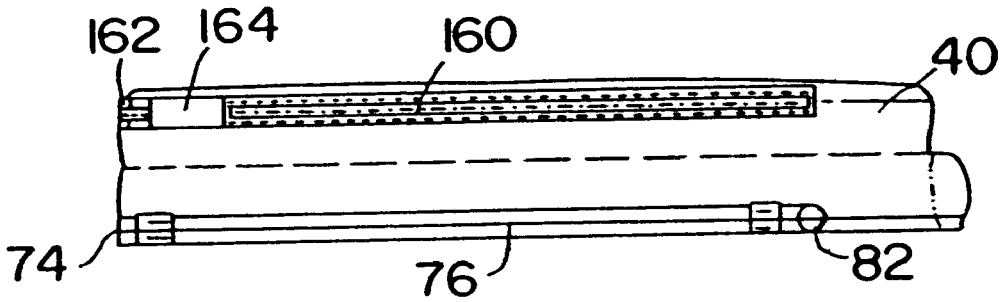

Additional details of the air wall bladder 38 are illustrated in FIGS. 6–8. Because the impermeable cover 18 is coupled to the base 12, there is no way for air flowing through fluidized seat zone 48 and fluidized foot zone 54 to escape from mattress 10. Therefore, the side portions 40 and 42 of air wall bladder 38 are formed to include vent slots 160. Tubes 164 are located within side portions 40 and 42 aligned with slots 160. The tubes 164 are fabric tubes having holes to permit air flow into the tubes 164. The tubes 164 are illustratively RF welded around the boundary of slots 160. Tubes 164 include connectors 162 which extend through end wall 44 of air wall bladder 38. Connectors 162 are configured to be coupled to tubes 165 as illustrated in FIG. 1. Tubes 165 extend through apertures 167 in top cover 18. Opposite ends of tubes 165 are coupled to an exhaust fan 166 configured to withdraw air from the interior region of mattress 10 through vent slots 160, tubes 164, tubes 165, and fan 166. This provides an exhaust for air entering the mattress 10 through the fluidized seat zone 48 and fluidized foot zone 54. It is understood that other air fluidized zones may be included within the mattress 10 if desired.

It is understood that the air impermeable cover 18 may be replaced with an upper low air loss section if desired. The upper low air loss section would permit air passing through the fluidized seat zone 48 and fluidized foot zone 54 to disburse through the low air loss cover without requiring an exhaust mechanism.

Figures 9, 10:
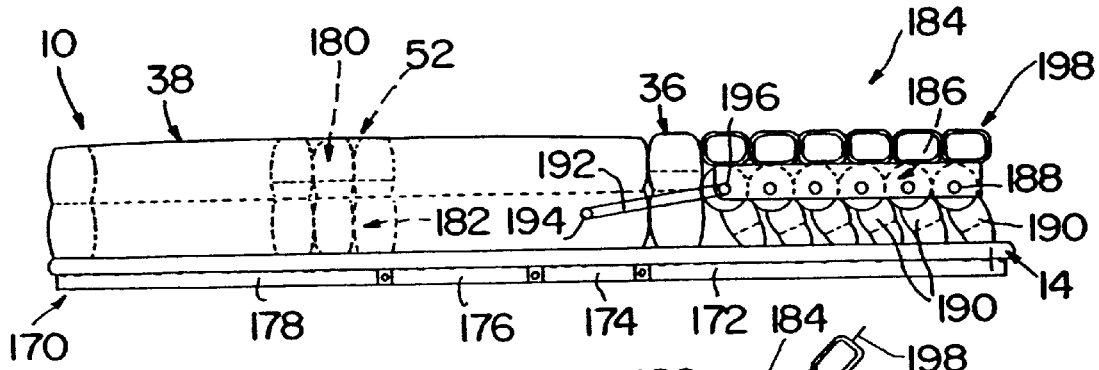
FIG. 9 is a sectional view illustrating details of another embodiment of the present invention which includes a reduced shear head support section.
FIG. 10 is a sectional view similar to FIG. 9 illustrating movement of air bladders within the head section of the mattress toward a head into the mattress as a head section is pivoted upwardly to an angled position.

Another embodiment of the head section of the present invention is illustrated in FIGS. 9 and 10. In this embodiment, the replacement mattress is located on an articulating deck 170 of a bed. The deck includes a head section 172, a seat section 174, a thigh section 176, and a foot section 178. FIGS. 9 and 10 show an alternative embodiment of the knee zone 52 which includes upper and lower chambers 180 and 182. Preferably, the partitioned bladder sections 180 and 182 are maintained at different pressures. Those elements in FIGS. 9 and 10 identified by reference numbers the same as in FIGS. 1–8 perform the same or similar functions. More particularly, the seat zone 48, the foot zone 54, and the air wall bladder 38 of FIGS. 9 and 10 include substantially identical structures as those identified above.

The mattress 10 of FIGS. 9 and 10 includes a reduced shear head support section 184. In the embodiment of FIGS. 9 and 10, a first array of air bladders 186 are coupled together by a web of material 188 coupled to the end of each air bladder 186. Illustratively, a web 188 is located at each end of the array of tubes 186. Tubes 186 are also tethered to bottom surface 14 of base 12 by tethers or by air bladders 190 which are coupled to base 14 and to air bladders 186. The web of material 188 and the array of bladders 186 are coupled to air wall bladder 38 by strap 192. Strap 192 includes a first end 194 coupled to air wall bladder 38 and a second end 196 coupled to web 188. Strap is coupled by suitable fasteners such as snaps. Illustratively, a strap 192 is located on both sides of mattress 10. A second array of bladders 198 are located on top of bladders 186. Bladders 198 are coupled to bladders 186.

As the head section 172 of deck 170 moves upwardly to an elevated position as illustrated in FIG. 10, the bladder 186 adjacent lumbar cushion 36 engages the lumbar cushion 36 and causes the array of bladders 186 to pivot on tether bladders 190 relative to bottom surface 14 of base 12. This causes the array of bladders 186 to move in the direction of arrow 200 toward head end 23 of mattress 10. The top array of bladders 198 moves with the bottom array of bladders 186. Illustratively, the bladders 186 and 198 move about 4–5 inches toward the head end 23 of mattress 10 as the head section of mattress 10 is articulated. This causes reduced shear forces against a patient lying on the mattress. If desired, an anti-shear material can be positioned between the array of bladders 198 and the top cover 18 (shown in FIG. 1) to facilitate sliding movement therebetween. The top array of bladders 198 may have any desired shape. For instance, the bladders may be generally rectangular as shown in FIGS. 9 and 10, or the bladders 198 may be round such as the bladders 186.

Figure 11:
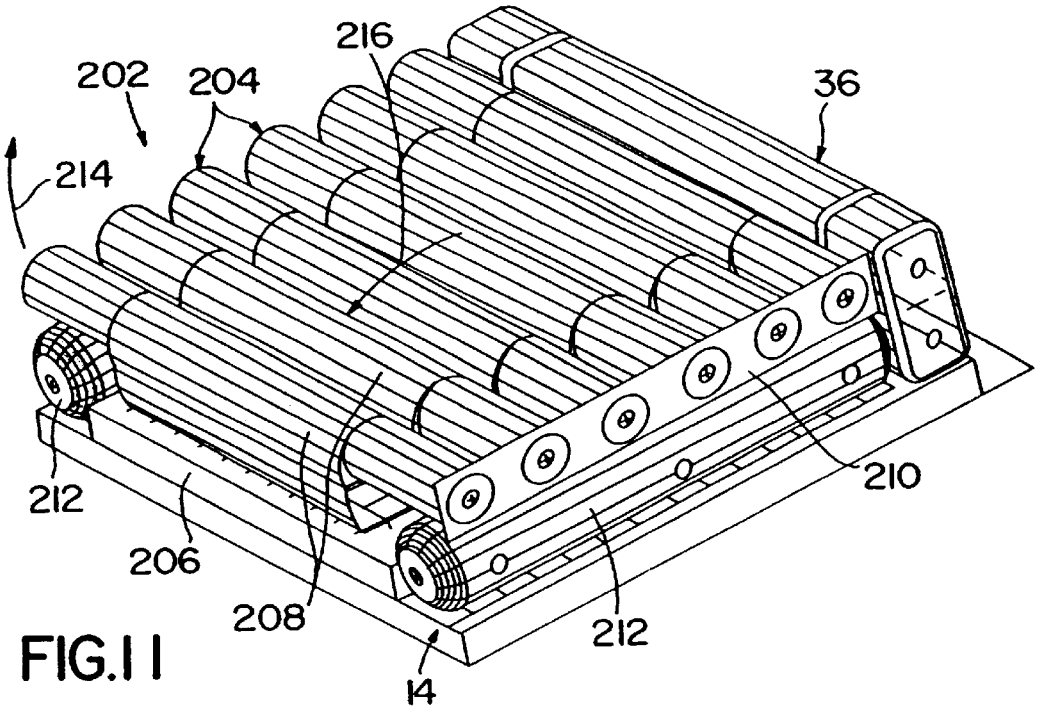
FIG. 11 is a perspective view of another embodiment of a reduced shear head support section for use with the mattress replacement of the present invention.

FIG. 11 illustrates another embodiment of the reduced shear head section of the present invention. The head section 202 includes an array of tubes 204 which are tethered to a central inflated section 206 by tethers or air bladders 208. Opposite ends of tubes 204 are coupled together by a web 210 of material secured to tubes 204 by suitable technique such as RF welding. A pair of inflated side bolsters 212 are located on opposite sides of central inflated section 206. The array of tubes 204 is located adjacent lumbar cushion 36. As the head section 202 is pivoted upwardly in the direction of arrow 214, the first bladder 204 engages lumbar section 36 and causes movement of the array of bladders 204 in the direction of arrow 216 to reduce shear forces on a body lying on the mattress 10.

Figure 12:
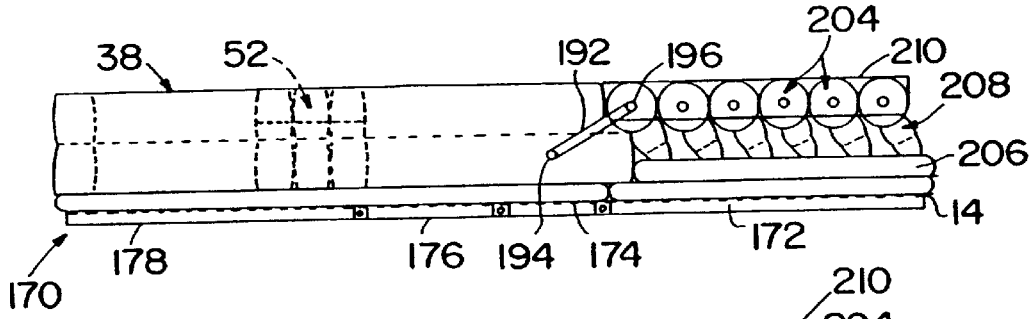
FIGS. 12 and 13 illustrate yet another embodiment of a reduced shear head section of the present invention.
Figure 13:
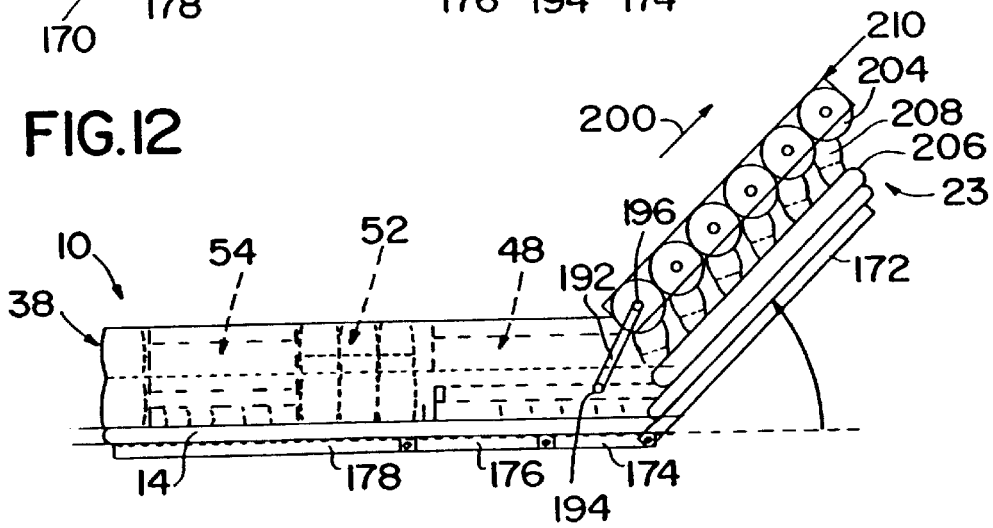

FIGS. 12 and 13 illustrate another embodiment of the reduced shear head section which is similar to the embodiment illustrated in FIG. 11. In this embodiment, however, a strap 192 is used to tie the head section 202 to the air wall bladder 38 as discussed above. First end 194 of strap 192 is coupled to the air wall bladder 38 by suitable connectors such as a snap or other suitable connector. The second end 196 of strap 192 is coupled to the array of bladders 204. As the head section 202 is pivoted upwardly, the bladder 204 engages the air wall bladder 38 or a lumbar cushion, if installed, to cause the array of bladders 204 to pivot relative to bottom surface 14 of base 12. This causes bladders 204 to move in the direction of arrow 200 toward the head end 23 of mattress 10. Those elements in FIGS. 12 and 13 identified by reference numerals the same as in FIGS. 1–8 perform the same or similar functions. More particularly, the seat zone 48, the foot zone 54, and the air wall bladder 38 of FIGS. 12 and 13 all have substantially identical structures as those identified above.

Although the invention has been described in detail with reference to certain illustrative embodiments, variations and modifications exist within the scope and spirit of the present invention as defined in the following claims.

What is claimed is:

1. A mattress comprising:

a first support section; and a head support section configured to move relative to the first support section, the head support section including a base, first and second laterally spaced inflatable side bolsters extending longitudinally above the base, an array of bladders extending laterally above the base, and a plurality of couplers operably coupling the base to the array of bladders such that the array of bladders move relative to the base toward the head end of the mattress in response to movement of the head support section relative to the first support section.

2. The mattress of claim 1, wherein the first support section includes at least one air fluidized module containing a fluidizable material, the at least one fluidized module being connected to an air supply.

3. The mattress of claim 2, wherein the first support section further includes an inflatable non-fluidized zone.

4. The mattress of claim 1, further comprising a web of material coupled to the array of air bladders so that the array of air bladders moves together.

5. The mattress of claim 1, wherein the plurality of couplers comprises a plurality of tethers configured to pivotably couple the array of bladders to the base.

6. The mattress of claim 5, wherein the tethers comprise air bladders.

7. The mattress of claim 1, further comprising a lumbar bladder located between the first support section and the head support section, the lumbar bladder being configured to engage the array of bladders and move the array of bladders toward a head end of the mattress as the head support section is moved to an elevated position.

8. The mattress of claim 1, further comprising a coupler operably coupling the first support section and the head support section.

9. A mattress comprising:

a first support section; and a head support section configured to move relative to the first support section, the head support section including a base, the base having an inflatable central section and first and second inflatable side bolsters located on opposite sides of the central section, an array of bladders positioned above the base, and a plurality of tethers operably coupling the array of bladders to the central section such that the array of bladders may move relative to the base toward the head end of the mattress.

10. The mattress of claim 9, wherein the first support section includes at least one air fluidized module containing a fluidizable material, the at least one fluidized module being connected to an air supply.

11. The mattress of claim 9, further comprising a web of material coupled to the array of air bladders so that the array of air bladders moves together.

12. The mattress of claim 9, wherein the tethers comprise air bladders.

13. The mattress of claim 9, further comprising a lumbar bladder located between the first support section and the head support section, the lumbar bladder being configured to engage the array of bladders and move the array of bladders toward a head end of the mattress as the head support section is moved to an elevated position.

14. The mattress of claim 9, further comprising a coupler operably coupling the first support section and the head support section.

15. A mattress comprising:

a first support section defining a foot end of the mattress;

a second support section defining a head end of the mattress and configured to be moved to an elevated position relative to the first support section, the second support section including a base, a shear reducing support surface, and a coupler configured to operably couple the base to the shear reducing support surface so that the shear reducing support surface moves toward the head end of the mattress as the second support section is moved to the elevated position relative to the first support section.

16. The mattress of claim 15, wherein the coupler comprises a tether which pivotably couples the shear reducting support surface to the base.

17. The mattress of claim 16, wherein the tether comprises an air bladder.

18. The mattress of claim 15, further comprising a second coupler operably coupling the first support section and the second support section.

19. The mattress of claim 15, wherein the shear reducing support surface is defined by an array of air bladders pivotably coupled to the base.

20. The mattress of claim 19, further comprising first and second laterally spaced inflatable side bolsters extending longitudinally above the base.

21. The mattress of claim 19, further comprising a web of material coupled to the array of air bladders so that the array of air bladders moves together.

22. The mattress of claim 15, wherein the first support section comprises:

a module receiving section having a first coupling portion in fluid communication with an air supply; and an air fluidized module having a first chamber containing a fluidizable material, a second chamber, a second coupling portion coupled to the module in fluid communication with the second chamber, and an air permeable sheet located between the first and second chambers, the air fluidized module being configured to be located in the module receiving section, and the first and second coupling portions being configured to be coupled together to provide fluid communication between the air supply and the second chamber so that air from the air supply passes into the second chamber and through the air permeable sheet to fluidize the fluidizable material in the first chamber.

* * * * *